US009552770B2

(12) United States Patent
Song et al.

(10) Patent No.: US 9,552,770 B2
(45) Date of Patent: Jan. 24, 2017

(54) EMISSION DRIVER, ORGANIC LIGHT-EMITTING DIODE (OLED) DISPLAY INCLUDING THE SAME, AND ELECTRONIC DEVICE

(71) Applicant: Samsung Display Co., Ltd., Yongin, Gyeonggi-do (KR)

(72) Inventors: Hwa-Young Song, Seoul (KR); Dong-Hwi Kim, Asan-si (KR); Jin Jeon, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 9 days.

(21) Appl. No.: 14/597,100

(22) Filed: Jan. 14, 2015

(65) Prior Publication Data

US 2016/0055798 A1 Feb. 25, 2016

(30) Foreign Application Priority Data

Aug. 20, 2014 (KR) ..... 10-2014-0108205

(51) Int. Cl.
*G09G 5/10* (2006.01)
*G09G 3/32* (2016.01)

(52) U.S. Cl.
CPC .... *G09G 3/3233* (2013.01); *G09G 2300/0861* (2013.01); *G09G 2320/0606* (2013.01); *G09G 2320/0613* (2013.01)

(58) Field of Classification Search
USPC ..... 345/80, 82, 173, 214, 419, 690, 691, 213,345/76
See application file for complete search history.

(56) References Cited

U.S. PATENT DOCUMENTS

2005/0219229 A1* 10/2005 Yamaguchi ..... G06F 3/0412 345/173
2006/0071888 A1* 4/2006 Lee ..... G09G 3/3233 345/82
2006/0156118 A1 7/2006 Shin
2009/0033651 A1* 2/2009 Okamoto ..... G09G 3/20 345/214

(Continued)

FOREIGN PATENT DOCUMENTS

KR 10-2006-0080636 A1 7/2006
KR 10-2011-0090608 A 8/2011

(Continued)

*Primary Examiner* — Thuy Pardo
(74) *Attorney, Agent, or Firm* — Knobbe, Martens, Olson & Bear, LLP

(57) ABSTRACT

An emission driver, organic light-emitting diode (OLED) display including the same, and electronic device are disclosed. In one aspect, the emission driver includes first through (n)th emission circuits configured to output a plurality of emission control signals. The emission circuits are connected to a display panel of an OLED display via emission-lines. The emission driver also includes a plurality of first switches configured to electrically connect the emission circuits in series when the first switches are turned on and a plurality of second switches configured to electrically connect the emission circuits in parallel when the second switches are turned on. The second switches are further configured to be turned off when the first switches are turned on and the second switches are further configured to be turned on when the first switches are turned off.

20 Claims, 9 Drawing Sheets

(56) References Cited

U.S. PATENT DOCUMENTS

| | | | | |
|---|---|---|---|---|
| 2009/0167649 | A1* | 7/2009 | Ishizuka | G09G 3/3258 345/80 |
| 2009/0303163 | A1* | 12/2009 | Kohno | G09G 3/3225 345/76 |
| 2011/0187691 | A1 | 8/2011 | Chung | |
| 2012/0127221 | A1* | 5/2012 | Tamaki | G09G 3/3233 345/691 |
| 2012/0139962 | A1 | 6/2012 | Chung et al. | |
| 2012/0146999 | A1* | 6/2012 | Hwang | G09G 3/003 345/419 |
| 2013/0222352 | A1 | 8/2013 | Jeong | |
| 2013/0321486 | A1* | 12/2013 | Cha | G09G 5/10 345/690 |
| 2014/0028732 | A1* | 1/2014 | Kim | G09G 3/3208 345/690 |
| 2014/0125709 | A1* | 5/2014 | Shibata | G09G 3/3406 345/690 |

FOREIGN PATENT DOCUMENTS

| | | | |
|---|---|---|---|
| KR | 10-2011-00900608 | A | 8/2011 |
| KR | 10-2012-0062493 | A | 6/2012 |
| KR | 10-2013-0099588 | A | 9/2013 |

* cited by examiner

EMISSION DRIVER, ORGANIC LIGHT-EMITTING DIODE (OLED) DISPLAY INCLUDING THE SAME, AND ELECTRONIC DEVICE

CROSS-REFERENCE TO RELATED APPLICATIONS

This application claims priority under 35 USC §119 to Korean Patent Application No. 10-2014-0108205, filed on Aug. 20, 2014 in the Korean Intellectual Property Office (KIPO), the contents of which are incorporated herein in its entirety by reference.

BACKGROUND

Field

The described technology generally relates to an emission driver for an organic light-emitting diode (OLED) display, an OLED display including the emission driver, and an electronic device including the OLED display.

Description of the Related Technology

Recently, OLED displays have become widely used as components of various electronic devices. OLED displays can be driven via different driving techniques such as a progressive emission technique and a simultaneous emission technique. Specifically, the progressive emission technique sequentially drives a scan signal to the pixels via a number of scan-lines and then sequentially drives an emission signal to the pixels via a number of emission-lines. In contrast, the simultaneous emission technique sequentially drives a scan signal to the pixels via the scan-lines and then simultaneously drives an emission signal to the pixels.

SUMMARY OF CERTAIN INVENTIVE ASPECTS

One inventive aspect is an emission driving unit for an OLED display that can sequentially provide emission control signals to a display panel in a progressive emission mode and simultaneously provide the emission control signals to the display panel in a simultaneous emission mode.

Another aspect is an OLED display including the emission driving unit.

Another aspect is an electronic device (e.g., a mobile device) including the OLED display.

Another aspect is an emission driving unit including first through (n)th emission driving blocks configured to output emission control signals to a display panel of an OLED display via first through (n)th emission-lines, where n is an integer greater than or equal to 2, first switches configured to arrange the first through (n)th emission driving blocks in series when the first switches are turned on based on a first switch control signal for sequentially outputting the emission control signals to the display panel, and second switches configured to arrange the first through (n)th emission driving blocks in parallel when the second switches are turned on based on a second switch control signal for simultaneously outputting the emission control signals to the display panel. Here, the second switches may be turned off when the first switches are turned on, and the second switches may be turned on when the first switches are turned off.

In example embodiments, the first switches may be turned on and the second switches may be turned off when the OLED display operates in a progressive emission mode.

In example embodiments, the emission control signals may be sequentially generated based on a sequential driving clock signal input to the first emission driving block when the OLED display operates in the progressive emission mode.

In example embodiments, the first switches may be turned off and the second switches may be turned on when the OLED display operates in a simultaneous emission mode.

In example embodiments, the emission control signals may be simultaneously generated based on a simultaneous driving clock signal input to the first through (n)th emission driving blocks when the OLED display operates in the simultaneous emission mode.

In example embodiments, the first and second switches may be implemented by P-channel Metal Oxide Semiconductor (PMOS) transistors or N-channel Metal Oxide Semiconductor (NMOS) transistors.

In example embodiments, each of the first switches may include a first terminal that receives a sequential driving clock signal or a previous emission control signal, a second terminal that is connected to one of the first through (n)th emission driving blocks, and a gate terminal that receives the first switch control signal.

In example embodiments, each of the second switches may include a first terminal that receives a simultaneous driving clock signal, a second terminal that is connected to one of the first through (n)th emission driving blocks, and a gate terminal that receives the second switch control signal.

Another aspect is an OLED display including a display panel including a plurality of pixels, a scan driving unit configured to provide scan signals to the display panel via first through (n)th scan-lines, where n is an integer greater than or equal to 2, a data driving unit configured to provide data signals to the display panel via first through (m)th data-lines, where m is an integer greater than or equal to 2, an emission driving unit configured to sequentially or simultaneously provide emission control signals to the display panel via first through (n)th emission-lines, a mode control unit configured to control the emission driving unit based on emission modes of the OLED display, a power unit configured to provide a high power voltage and a low power voltage to the display panel, and a timing control unit configured to control the scan driving unit, the data driving unit, the mode control unit, and the power unit.

In example embodiments, the mode control unit may be implemented within the timing control unit.

In example embodiments, the emission driving unit may include first through (n)th emission driving blocks configured to output the emission control signals to the display panel via the first through (n)th emission-lines, first switches configured to arrange the first through (n)th emission driving blocks in series when the first switches are turned on based on a first switch control signal for sequentially outputting the emission control signals to the display panel, and second switches configured to arrange the first through (n)th emission driving blocks in parallel when the second switches are turned on based on a second switch control signal for simultaneously outputting the emission control signals to the display panel. Here, the second switches may be turned off when the first switches are turned on, and the second switches may be turned on when the first switches are turned off.

In example embodiments, the first switches may be turned on, and the second switches may be turned off when the OLED display operates in a progressive emission mode.

In example embodiments, the emission control signals may be sequentially generated based on a sequential driving clock signal input to the first emission driving block when the OLED display operates in the progressive emission mode.

In example embodiments, the first switches may be turned off, and the second switches may be turned on when the OLED display operates in a simultaneous emission mode.

In example embodiments, the emission control signals may be simultaneously generated based on a simultaneous driving clock signal input to the first through (n)th emission driving blocks when the OLED display operates in the simultaneous emission mode.

Another aspect is an electronic device including an OLED display configured to selectively operate in a progressive emission mode or in a simultaneous emission mode by sequentially or simultaneously generating emission control signals according to an external command, the emission control signals controlling emission operations of a plurality of pixels included in a display panel of the OLED display, and a processor configured to control the OLED display.

In example embodiments, the external command may be input by a user, or selected by a predetermined algorithm according to images to be displayed on the display panel.

In example embodiments, the OLED display may include the display panel including the pixels, a scan driving unit configured to provide scan signals to the display panel via first through (n)th scan-lines, where n is an integer greater than or equal to 2, a data driving unit configured to provide data signals to the display panel via first through (m)th data-lines, where m is an integer greater than or equal to 2, an emission driving unit configured to sequentially or simultaneously provide the emission control signals to the display panel via first through (n)th emission-lines, a mode control unit configured to control the emission driving unit based on emission modes of the OLED display, a power unit configured to provide a high power voltage and a low power voltage to the display panel, and a timing control unit configured to control the scan driving unit, the data driving unit, the mode control unit, and the power unit.

In example embodiments, the emission driving unit may include first through (n)th emission driving blocks configured to output the emission control signals to the display panel via the first through (n)th emission-lines, first switches configured to arrange the first through (n)th emission driving blocks in series when the first switches are turned on based on a first switch control signal for sequentially outputting the emission control signals to the display panel, and second switches configured to arrange the first through (n)th emission driving blocks in parallel when the second switches are turned on based on a second switch control signal for simultaneously outputting the emission control signals to the display panel. Here, the second switches may be turned off when the first switches are turned on, and the second switches may be turned on when the first switches are turned off.

In example embodiments, the first switches may be turned on, and the second switches may be turned off when the OLED display operates in the progressive emission mode.

In example embodiments, the first switches may be turned off, and the second switches may be turned on when the OLED display operates in the simultaneous emission mode.

Another aspect is an emission driver, comprising first through (n)th emission circuits respectively configured to output first through (n)th emission control signals, wherein the first through (n)th emission circuits are respectively connected to a display panel of an organic light-emitting diode (OLED) display via first through (n)th emission-lines, where n is an integer greater than or equal to 2; a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

In example embodiments, the first switches are further configured to be turned on and the second switches are further configured to be turned off when the OLED display operates in a progressive emission mode. The first through (n)th emission circuits can be further configured to sequentially generate the emission control signals based on a sequential driving clock signal applied to the first emission circuit when the OLED display operates in the progressive emission mode. The first switches can be further configured to be turned off and the second switches can be further configured to be turned on when the OLED display operates in a simultaneous emission mode. The first through (n)th emission circuits can be further configured to simultaneously generate the emission control signals based on a simultaneous driving clock signal applied to each of the first through (n)th emission circuits when the OLED display operates in the simultaneous emission mode.

In example embodiments, the first and second switches are implemented by P-channel Metal Oxide Semiconductor (PMOS) transistors or N-channel Metal Oxide Semiconductor (NMOS) transistors. Each of the first switches can include: i) a first terminal configured to receive a sequential driving clock signal or a previous emission control signal, ii) a second terminal connected to one of the first through (n)th emission circuits, and iii) a gate terminal configured to receive a first switch control signal. Each of the second switches can include: i) a first terminal configured to receive a simultaneous driving clock signal, ii) a second terminal connected to one of the first through (n)th emission circuits, and iii) a gate terminal configured to receive a second switch control signal.

Another aspect is an organic light-emitting diode (OLED) display, comprising a display panel including a plurality of pixels; a scan driver configured to apply a plurality of scan signals to the display panel via first through (n)th scan-lines, where n is an integer greater than or equal to 2; a data driver configured to provide a plurality of data signals to the display panel via first through (m)th data-lines, where m is an integer greater than or equal to 2; an emission driver configured to sequentially or simultaneously provide a plurality of emission control signals to the display panel via first through (n)th emission-lines; a mode controller configured to control the emission driver based on a selected emission mode of the OLED display; a power supply configured to provide a high power voltage and a low power voltage to the display panel; and a timing controller configured to control the scan driver, the data driver, the mode controller and the power supply.

In example embodiments, the mode controller is implemented within the timing controller. The emission driver can include first through (n)th emission circuits configured to respectively output the emission control signals to the display panel via the first through (n)th emission-lines; a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

In example embodiments, the first switches are further configured to be turned on and the second switches are further configured to be turned off when the OLED display operates in a progressive emission mode. The emission circuits can be further configured to sequentially generate the emission control signals based on a sequential driving clock signal applied to the first emission circuit when the OLED display operates in the progressive emission mode. The first switches can be further configured to be turned off and the second switches can be further configured to be turned on when the OLED display operates in a simultaneous emission mode. The emission circuits can be further configured to simultaneously generate the emission control signals based on a simultaneous driving clock signal applied to each of the emission circuits when the OLED display operates in the simultaneous emission mode.

Another aspect is an electronic device comprising an organic light-emitting diode (OLED) display including a display panel comprising a plurality of pixels, wherein the OLED display is configured to selectively operate in a progressive emission mode or in a simultaneous emission mode based on an external input and wherein the OLED display is further configured to i) generate a plurality of emission control signals and ii) selectively apply the emission control signals to the pixels in one of a sequential order or simultaneously; and a processor configured to control the OLED display.

In example embodiments, the OLED display is further configured to i) receive the external input from a user or ii) select the external input via a predetermined algorithm based on images to be displayed on the display panel.

In example embodiments, the OLED display further includes a scan driver configured to apply a plurality of scan signals to the display panel via first through (n)th scan-lines, where n is an integer greater than or equal to 2; a data driver configured to apply a plurality of data signals to the display panel via first through (m)th data-lines, where m is an integer greater than or equal to 2; an emission driver configured to sequentially or simultaneously apply the emission control signals to the display panel via first through (n)th emission-lines; a mode controller configured to control the emission driver based on a selected emission mode of the OLED display; a power supply configured to provide a high power voltage and a low power voltage to the display panel; and a timing controller configured to control the scan driver, the data driver, the mode controller, and the power supply.

In example embodiments, the driver includes first through (n)th emission circuits configured to respectively output the emission control signals to the display panel via the first through (n)th emission-lines; a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

In example embodiments, the first switches are further configured to be turned on and the second switches are further configured to be turned off when the OLED display operates in the progressive emission mode and wherein the first switches are further configured to be turned off and the second switches are further configured to be turned on when the OLED display operates in the simultaneous emission mode.

Therefore, an emission driving unit according to at least one embodiment, can control an OLED display to selectively operate in a progressive emission mode or in a simultaneous emission mode according to images to be displayed without any structural changes by sequentially providing emission control signals to a display panel in the progressive emission mode of the OLED display and by simultaneously providing the emission control signals to the display panel in the simultaneous emission mode of the OLED display.

In addition, an OLED display including the emission driving unit according to at least one embodiment can selectively operate in a progressive emission mode or in a simultaneous emission mode according to images to be displayed without any structural changes.

Further, an electronic device including the OLED display according to at least one embodiment can provide a high-quality image to a user.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

The structure of the emission driving unit included in an OLED display is determined based on the specific driving technique employed. For example, the emission driving unit included in an OLED display employing a progressive emission technique has a structure that sequentially provides emission control signals to the display panel. The emission driving unit included in an OLED display employing a simultaneous emission technique has a structure that simultaneously provides the emission control signals to the display panel. That is, since the emission driving unit included in the standard OLED display has a structure for performing one of the progressive or simultaneous emission techniques, the standard OLED display cannot selectively determine which emission technique to use based on the images to be displayed.

Hereinafter, embodiments of the described technology will be explained in detail with reference to the accompanying drawings.

Figure 1:
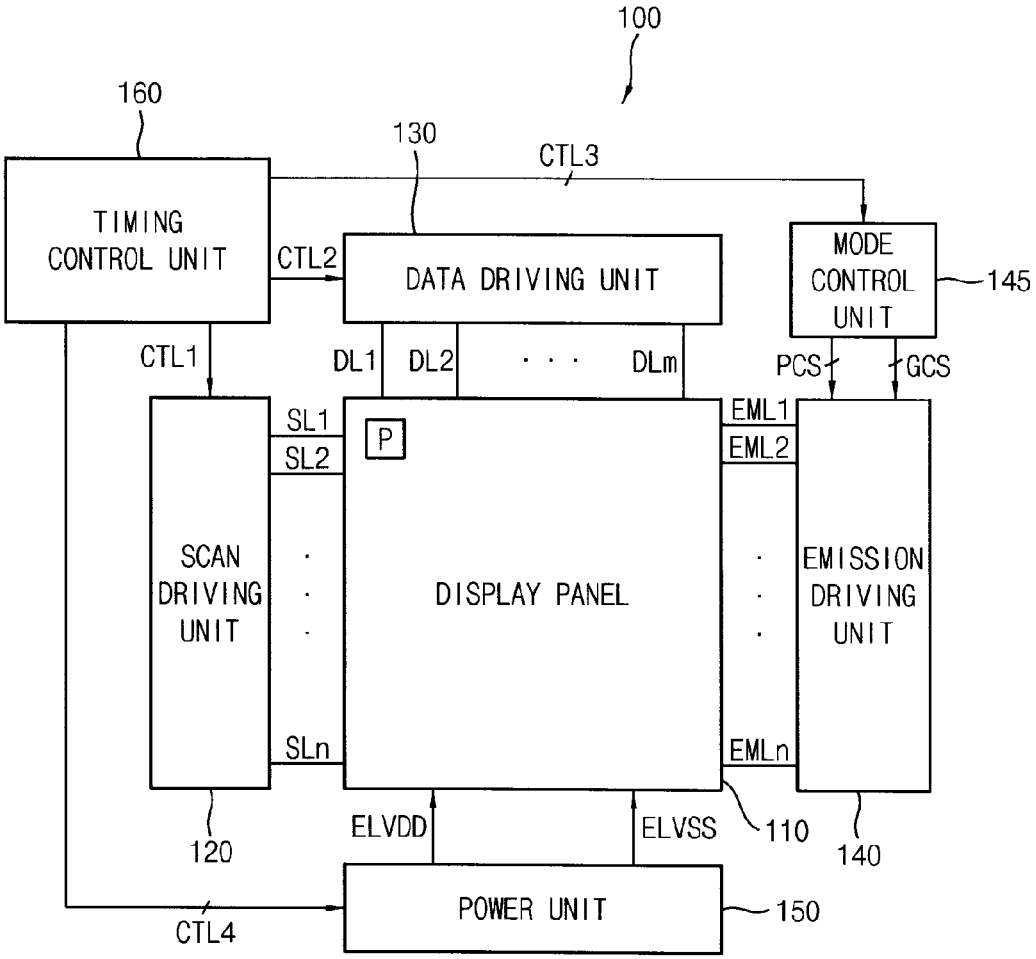
FIG. 1 is a block diagram illustrating an OLED display according to example embodiments.

FIG. 1 is a block diagram illustrating an organic light-emitting diode (OLED) display according to example embodiments.

Referring to FIG. 1, the OLED display 100 includes a display panel 110, a scan driving unit or scan driver 120, a data driving unit or data driver 130, and an emission driving unit or emission driver 140. The OLED display 100 further includes a mode control unit or mode controller 145, a power unit or power supply 150, and a timing control unit or timing controller 160. In an example embodiment, as illustrated in FIG. 1, the mode control unit 145 is located outside of the timing control unit 160. That is, the mode control unit 145 can be implemented separately from the timing control unit 160. In another example embodiment, the mode control unit 145 is located within the timing control unit 160. That is, the mode control unit 145 can be integrated with the timing control unit 160.

The display panel 110 includes a plurality of pixels P. The display panel 110 is connected to the scan driving unit 120 via first through (n)th scan-lines SL1 through SLn, where n is an integer greater than or equal to 2. The display panel 110 is also connected to the data driving unit 130 via first through (m)th data-lines DL1 through DLm, where m is an integer greater than or equal to 2. The display panel 110 is further connected to the emission driving unit 140 via first through (n)th emission-lines EML1 through EMLn. Here, since the pixels P are arranged at locations corresponding to the intersections between the first through (n)th scan-lines SL1 through SLn and the first through (m)th data-lines DL1 through DLm, the display panel 110 includes n×m pixels P. The scan driving unit 120 provides scan signals to the display panel 110 via the first through (n)th scan-lines SL1 through SLn. The data driving unit 130 provides data signals to the display panel 110 via the first through (m)th data-lines DL1 through DLm. The emission driving unit 140 sequentially or simultaneously provides emission control signals to the display panel 110 via the first through (n)th emission-lines EML1 through EMLn. The mode control unit 145 controls the emission driving unit 140 based a selected emission mode (e.g., a progressive emission mode or a simultaneous emission mode) of the OLED display 100. For this operation, the mode control unit 145 provides a first switch control signal PCS and a second switch control signal GCS to the emission driving unit 140. The power unit 150 provides a high power voltage ELVDD and a low power voltage ELVSS to the display panel 110. The timing control unit 160 generates a plurality of control signals CTL1, CTL2, CTL3, and CTL4 to control the scan driving unit 120, the data driving unit 130, the mode control unit 145, and the power unit 150. Thus, the timing control unit 160 respectively provides the control signals CTL1, CTL2, CTL3, and CTL4 to the scan driving unit 120, the data driving unit 130, the mode control unit 145, and the power unit 150. In some example embodiments, when the mode control unit 145 is integrated with the timing control unit 160, the timing control unit 160 directly controls the emission driving unit 140.

As described above, the mode control unit 145 controls the emission driving unit 140 to sequentially or simultaneously provide the emission control signals to the display panel 110 via the first through (n)th emission-lines EML1 through EMLn based on the emission mode (e.g., the progressive emission mode or the simultaneous emission mode) of the OLED display 100. For this operation, the emission driving unit 140 includes first through (n)th emission driving blocks, first switches, and second switches. The first through (n)th emission driving blocks output the emission control signals to the display panel 110 via the first through (n)th emission-lines EML1 through EMLn. The first switches arrange or electrically connect the first through (n)th emission driving blocks in series when the first switches are turned on based on a first switch control signal PCS for sequentially outputting the emission control signals to the display panel 110. The second switches arrange or electrically connect the first through (n)th emission driving blocks in parallel when the second switches are turned on based on a second switch control signal GCS for simultaneously outputting the emission control signals to the display panel 110. Here, the first switches and the second switches are operated to have opposing states (i.e., turned on or turned off). In other words, when the first switches are turned on, the second switches are turned off. In addition, when the first switches are turned off, the second switches are turned on. For example, when the emission mode of the OLED display 100 is the progressive emission mode, the first switches are turned on and the second switches are turned off. Thus, the emission control signals are sequentially output to the display panel 110 via the first through (n)th emission-lines EML1 through EMLn. On the other hand, when the emission mode of the OLED display 100 is the simultaneous emission mode, the first switches are turned off and the second switches are turned on. Thus, the emission control signals are simultaneously output to the display panel 110 via the first through (n)th emission-lines EML1 through EMLn. These operations will be described in detail with reference to FIGS. 2 through 11.

As described above, the emission driving unit 140 included in the OLED display 100 controls the OLED display 100 to selectively operate in the progressive emission mode or in the simultaneous emission mode without any structure change according to images to be displayed by sequentially providing the emission control signals to the display panel 110 in the progressive emission mode OLED display 100 and by simultaneously providing the emission control signals to the display panel 110 in the simultaneous emission mode OLED display 100. As a result, the OLED display 100 can sequentially drive a scan signal to n×m pixels P included in the display panel 110 by sequentially applying signals to the scan-lines SL1 through SLn and then can sequentially drive an emission signal to n×m pixels P included in the display panel 110 by sequentially applying signal to the emission-lines EML1 through EMLn (i.e., the progressive emission mode). Alternatively, the OLED display 100 can sequentially drive a scan signal to n×m pixels P included in the display panel 110 by sequentially applying signals to the scan-lines SL1 through SLn and then can simultaneously drive an emission signal to n×m pixels P included in the display panel 110 (i.e., the simultaneous emission mode). Therefore, an electronic device including the OLED display 100 can provide a high-quality image to a user. In some example embodiments, the scan driving unit 120, the data driving unit 130, the emission driving unit 140, the mode control unit 145, the power unit 150, and the timing control unit 160 are implemented by one integrated circuit (IC) chip. In some example embodiments, a subset of the scan driving unit 120, the data driving unit 130, the emission driving unit 140, the mode control unit 145, the power unit 150, and the timing control unit 160 are implemented by one integrated circuit (IC) chip.

Figure 2:
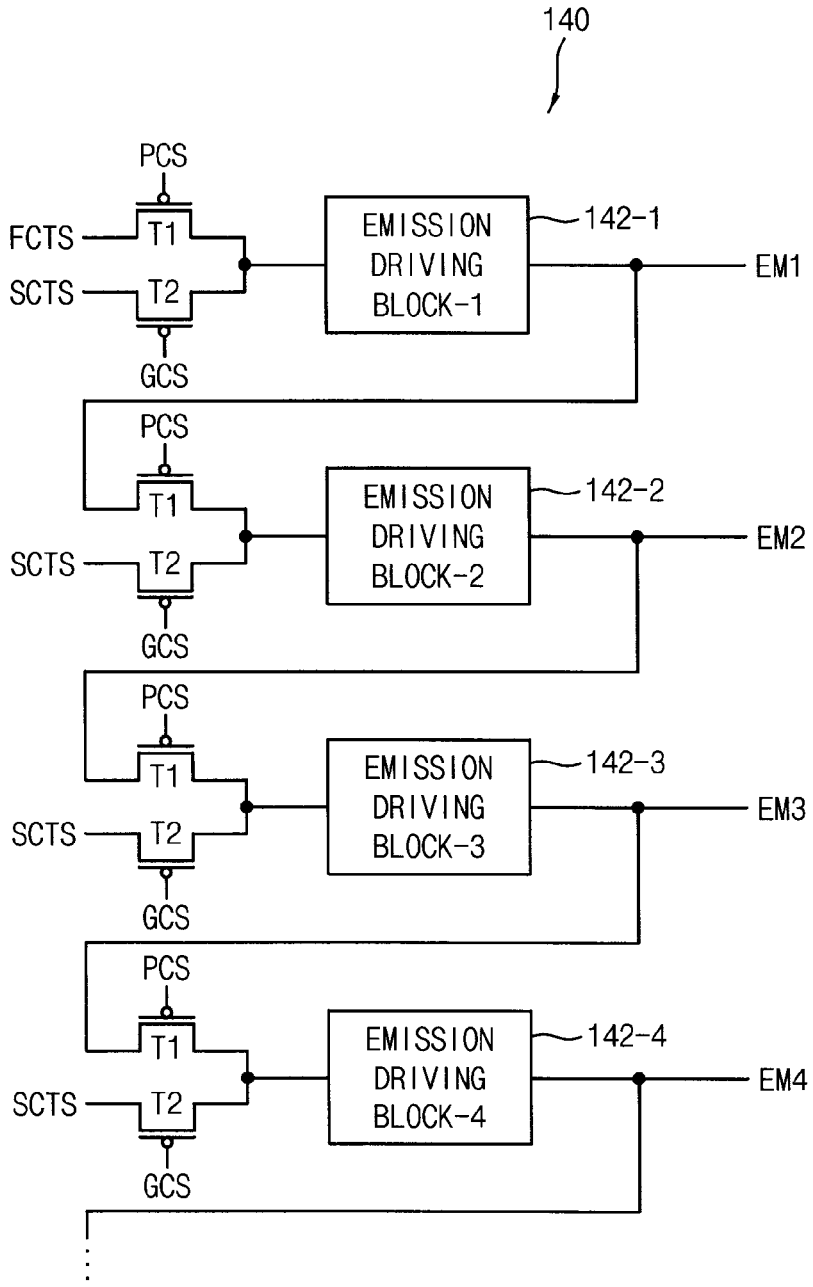
FIG. 2 is a block diagram illustrating an emission driving unit according to example embodiments.
Figure 3:
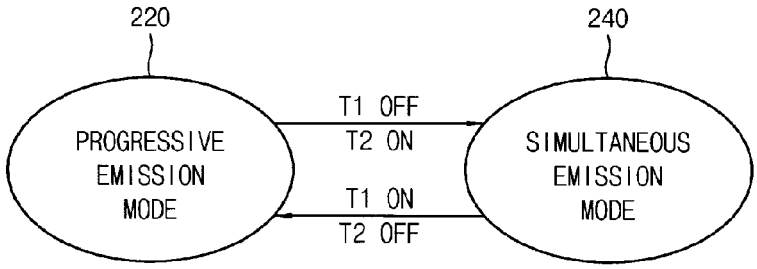
FIG. 3 is a diagram for describing emission modes of an OLED display including the emission driving unit of FIG. 2.

FIG. 2 is a block diagram illustrating an emission driving unit according to example embodiments. FIG. 3 is a diagram for describing emission modes of an OLED display including the emission driving unit of FIG. 2.

Referring to FIGS. 2 and 3, the emission driving unit 140 of the OLED display 100 includes first through (n)th emission driving blocks or emission driving circuits 142-1 through **142-*n*, first switches T1, and second switches T2. As illustrated in FIG. 3, the emission driving unit 140 sequentially or simultaneously outputs first through (n)th emission control signals EM1 through EMn to the display panel 110 via first through (n)th emission-lines EML1 through EMLn according to whether the emission mode of the OLED display 100 is a progressive emission mode 220 or a simultaneous emission mode 240**.

The first through (n)th emission driving blocks 142-1 through **142-*n* output the first through (n)th emission control signals EM1 through EMn to the display panel 110 via the first through (n)th emission-lines EML1 through EMLn. Specifically, the respective input terminals of the first through (n)th emission driving blocks 142-1 through 142-*n* are connected to a first switch T1 and a second switch T2. In addition, the output terminals of the first through (n)th emission driving blocks 142-1 through 142-*n* are respectively connected to the first through (n)th emission-lines EML1 through EMLn. Thus, the first through (n)th emission control signals EM1 through EMn are respectively output via the first through (n)th emission-lines EML1 through EMLn. In addition, the output terminal of a previous emission driving block 142-1 through 142-*n* is connected to the input terminal of the next emission driving block 142-1 through 142-*n* via the first switch T1. For example, when the OLED display 100 operates in the progressive emission mode 220, the first switches T1 are turned on (i.e., indicated as T1 ON) and the second switches T2 are turned off (i.e., indicated as T2 OFF). Accordingly, the first through (n)th emission driving blocks 142-1 through 142-*n* are arranged in series. As a result, the first through (n)th emission control signals EM1 through EMn sequentially output signals to the display panel 110. On the other hand, when the OLED display 100 operates in the simultaneous emission mode 240, the first switches T1 are turned off (i.e., indicated as T1 OFF) and the second switches T2 are turned on (i.e., indicated as T2 ON). Accordingly, the first through (n)th emission driving blocks 142-1 through 142-*n* are arranged in parallel. As a result, the first through (n)th emission control signals EM1 through EMn are simultaneously output to the display panel 110**.

The first switches T1 arrange the first through (n)th emission driving blocks 142-1 through **142-*n* in series when the first switches T1 are turned on based on the first switch control signal PCS for sequentially outputting the first through (n)th emission control signals EM1 through EMn to the display panel 110. For example, as illustrated in FIG. 2, the first switches T1 can be implemented by P-channel Metal-Oxide Semiconductor (PMOS) transistors. In this embodiment, when the first switch control signal PCS has a logic "low" level, the first switches T1 are turned on. Thus, the first through (n)th emission driving blocks 142-1 through 142-*n* are arranged in series. In an example embodiment, each of the first switches T1 includes a first terminal that receives a sequential driving clock signal FCTS or a previous emission control signal EM, a second terminal that is connected to one of the first through (n)th emission driving blocks 142-1 through 142-*n*, and a gate terminal that receives the first switch control signal PCS. For example, the first switch T1 connected to the input terminal of the first emission driving block 142-1 includes a first terminal that receives the sequential driving clock signal FCTS, a second terminal that is connected to the first emission driving block 142-1, and a gate terminal that receives the first switch control signal PCS. In addition, the first switch T1 connected to the input terminal of the second emission driving block 142-2 includes a first terminal that receives the first emission control signal EM1, a second terminal that is connected to the second emission driving block 142-2, and a gate terminal that receives the first switch control signal PCS. Although it is illustrated in FIG. 2 that the first switches T1 are implemented by PMOS transistors, the first switches T1 are not limited thereto. For example, the first switches T1** can be implemented by various switching circuits as well as N-channel Metal-Oxide Semiconductor (NMOS) transistors.

The second switches T2 arrange the first through (n)th emission driving blocks 142-1 through **142-*n* in parallel when the second switches T2 are turned on based on the second switch control signal GCS for simultaneously outputting the first through (n)th emission control signals EM1 through EMn to the display panel 110. For example, as illustrated in FIG. 2, the second switches T2 can be implemented by PMOS transistors. In this embodiment, when the second switch control signal GCS has a logic "low" level, the second switches T2 are turned on. Thus, the first through (n)th emission driving blocks 142-1 through 142-*n* are arranged in parallel. In an example embodiment, each of the second switches T2 includes a first terminal that receives a simultaneous driving clock signal SCTS, a second terminal that is connected to one of the first through (n)th emission driving blocks 142-1 through 142-*n*, and a gate terminal that receives the second switch control signal GCS. For example, the second switch T2 connected to the input terminal of the first emission driving block 142-1 includes a first terminal that receives the simultaneous driving clock signal SCTS, a second terminal that is connected to the first emission driving block 142-1, and a gate terminal that receives the second switch control signal GCS. In addition, the second switch T2 connected to the input terminal of the second emission driving block 142-2 includes a first terminal that receives the simultaneous driving clock signal SCTS, a second terminal that is connected to the second emission driving block 142-2, and a gate terminal that receives the second switch control signal GCS. Although it is illustrated in FIG. 2 that the second switches T2 are implemented by PMOS transistors, the second switches T2 are not limited thereto. For example, the second switches T2** can be implemented by various switching circuits as well as NMOS transistors.

The first and second switches T1 and T2 operate so as to have inverse states with respect to each other (i.e., turned on or turned off). In other words, when the first switches T1 are turned on, the second switches T2 are turned off. In addition, when the first switches T1 are turned off, the second switches T2 are turned on. Specifically, when the OLED display 100 operates in the progressive emission mode 220, the first switches T1 are turned on (i.e., indicated as T1 ON) and the second switches T2 are turned off (i.e., indicated as T2 OFF). In this situation, the first through (n)th emission control signals EM1 through EMn are sequentially generated based on the sequential driving clock signal FCTS input to the first emission driving block 142-1. That is, after the first emission driving block 142-1 outputs the first emission control signal EM1, the second emission driving block 142-2 outputs the second emission control signal EM2. In addition, after the second emission driving block 142-2 outputs the second emission control signal EM2, the third emission driving block 142-3 outputs the third emission control signal EM3. Further, after the third emission driving block 142-3 outputs the third emission control signal EM3, the fourth emission driving block 142-4 outputs the fourth emission control signal EM4. In this way, the first through (n)th emission control signals EM1 through EMn are sequentially output to the display panel 110. On the other hand, when the OLED display 100 operates in the simultaneous emission mode 240, the first switches T1 are turned off (i.e., indicated as T1 OFF) and the second switches T2 are turned on (i.e., indicated as T2 ON). In this situation, the first through (n)th emission control signals EM1 through EMn are simultaneously generated based on the simultaneous driving clock signal SCTS input to the first through (n)th emission driving blocks 142-1 through **142-*n*. Thus, the first through (n)th emission driving blocks 142-1 through 142-*n* simultaneously output the first through (n)th emission control signals EM1** through EMn.

As described above, the emission driving unit 140 included in the OLED display 100 controls the OLED display 100 to selectively operate in the progressive emission mode 220 or in the simultaneous emission mode 240 without any structural change, based on the images to be displayed, by sequentially providing the first through (n)th emission control signals EM1 through EMn to the display panel 110 in the progressive emission mode 220 or in the simultaneous emission mode 240. In some example embodiments, the sequential driving clock signal FCTS input via the first switches T1 is a Frame Line Mark (FLM) signal for sequential emission of the display panel 110 included in the OLED display 100. In some example embodiments, the simultaneous driving clock signal SCTS input via the second switches T2 is an FLM signal for simultaneous emission of the display panel 110 included in the OLED display 100. For example, the emission driving unit 140 receives the sequential driving clock signal FCTS and the simultaneous driving clock signal SCTS from the timing control unit 160 or the mode control unit 145 included in the OLED display 100. Similarly, the emission driving unit 140 receives the first switch control signal PCS applied to a gate terminal of the first switches T1 and the second switch control signal GCS applied to a gate terminal of the second switches T2 from the timing control unit 160 or the mode control unit 145 included in the OLED display 100. However, the components of the OLED display 100 for providing the sequential driving clock signal FCTS, the simultaneous driving clock signal SCTS, the first switch control signal PCS, and/or the second switch control signal GCS are not limited thereto.

Figure 4:
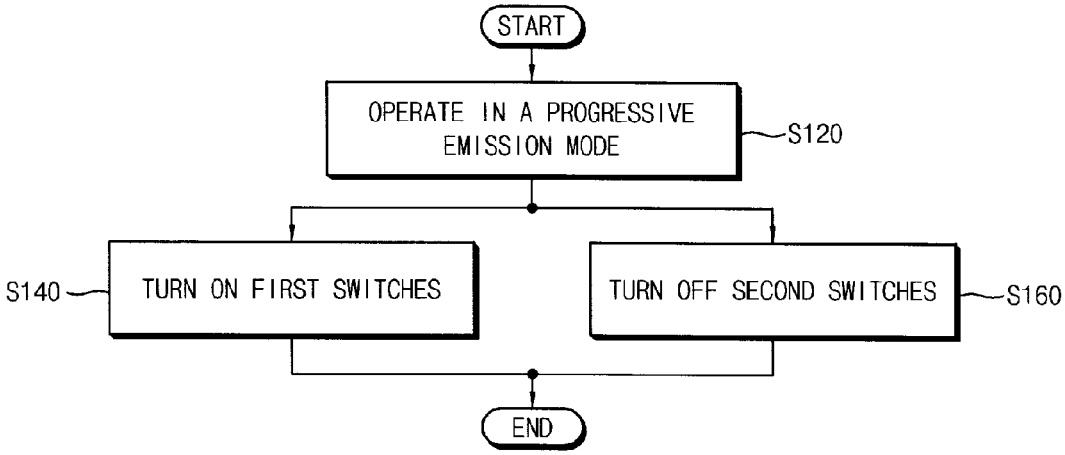
FIG. 4 is a flowchart illustrating an example in which the emission driving unit of FIG. 2 operates in a progressive emission mode.
Figure 5:
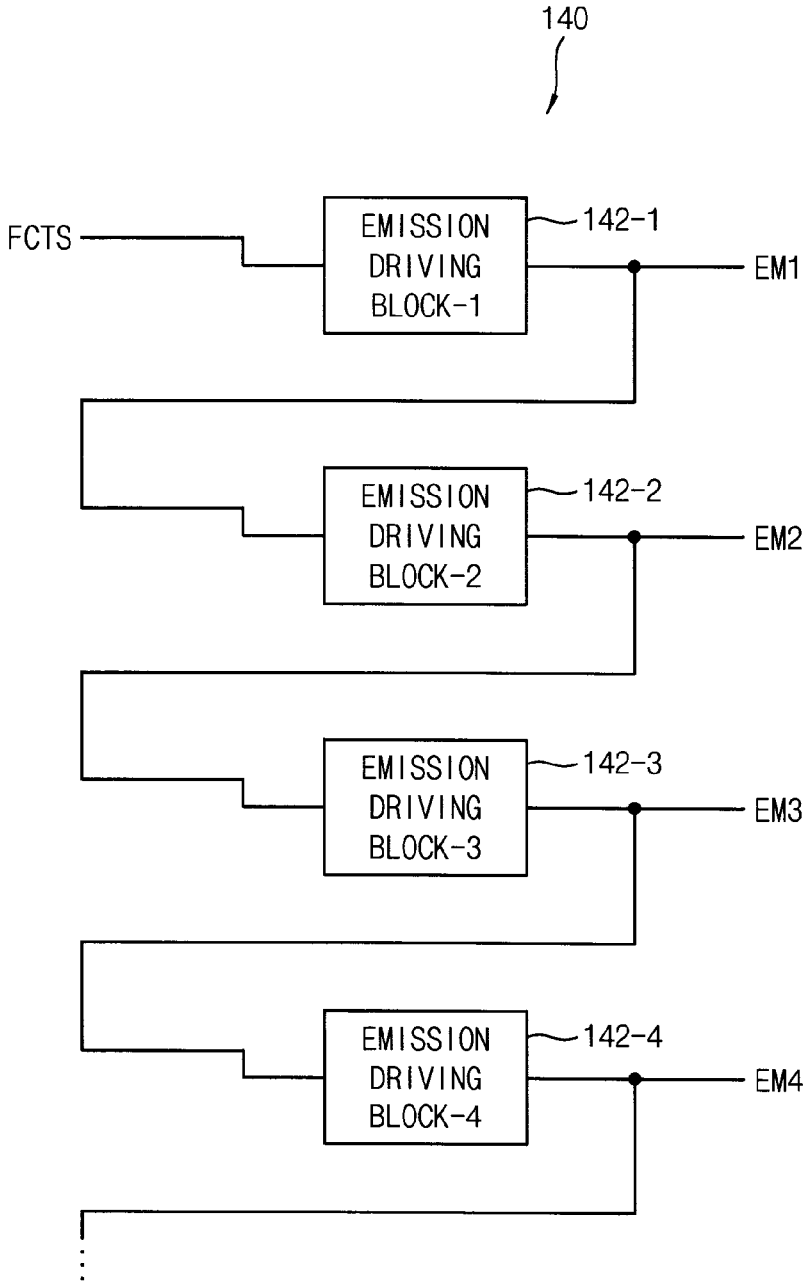
FIG. 5 is a block diagram illustrating an example in which the emission driving unit of FIG. 2 operates in a progressive emission mode.
Figure 6:
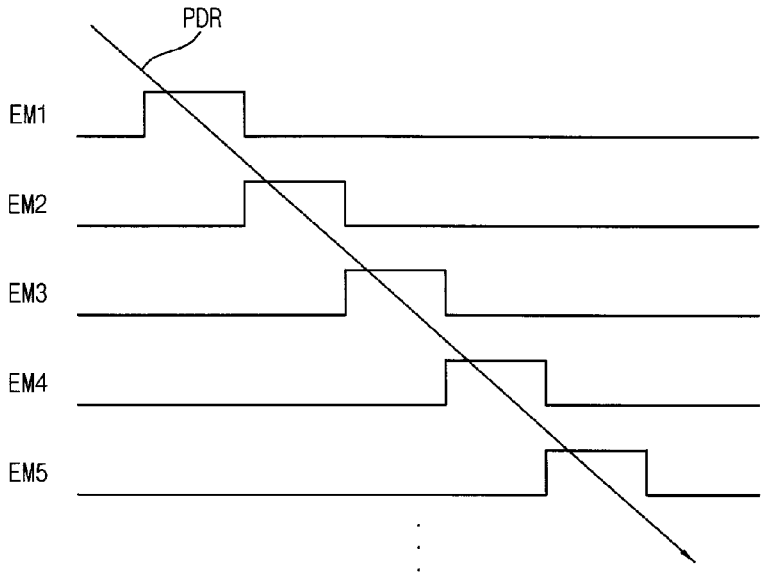
FIG. 6 is another diagram illustrating an example in which the emission driving unit of FIG. 2 operates in a progressive emission mode.

FIG. 4 is a flowchart illustrating an example in which the emission driving unit of FIG. 2 operates in a progressive emission mode. FIG. 5 is a block diagram illustrating an example in which the emission driving unit of FIG. 2 operates in a progressive emission mode. FIG. 6 is another diagram illustrating an example in which the emission driving unit of FIG. 2 operates in a progressive emission mode.

Referring to FIGS. 4 through 6, when the OLED display 100 operates in the progressive emission mode 220 (S120), the emission driving unit 140 turns on the first switches T1 based on the first switch control signal PCS for sequentially outputting the first through (n)th emission control signals EM1 through EMn to the display panel 110 (S140) and turns off the second switches T2 based on the second switch control signal GCS for simultaneously outputting the first through (n)th emission control signals EM1 through EMn to the display panel 110 (S160). For example, when the first switches T1 and the second switches T2 are implemented by PMOS transistors, the first switch control signal PCS has a logic "low" level and the second switch control signal GCS has a logic "high" level when the OLED display 100 operates in the progressive emission mode 220. Here, the first switch control signal PCS controls the first through (n)th emission control signals EM1 through EMn to be sequentially output to the display panel 110 and the second switch control signal GCS controls the first through (n)th emission control signals EM1 through EMn to be simultaneously output to the display panel 110. Thus, as illustrated in FIG. 5, when the first switches T1 are turned on and the second switches T2 are turned off, the first through (n)th emission driving blocks 142-1 through **142-*n* are arranged in series. As a result, the first through (n)th emission control signals EM1 through EMn are sequentially generated based on the sequential driving clock signal FCTS input to the first emission driving block 142-1. That is, after the first emission driving block 142-1 outputs the first emission control signal EM1, the second emission driving block 142-2 outputs the second emission control signal EM2. In addition, after the second emission driving block 142-2 outputs the second emission control signal EM2, the third emission driving block 142-3 outputs the third emission control signal EM3. Further, after the third emission driving block 142-3 outputs the third emission control signal EM3, the fourth emission driving block 142-4 outputs the fourth emission control signal EM4. Therefore, as illustrated in FIG. 6, since the first through (n)th emission control signals EM1 through EMn are sequentially output to the display panel 110 (i.e., indicated as PDR), the OLED display 100 operates in the progressive emission mode 220**.

Figure 7:
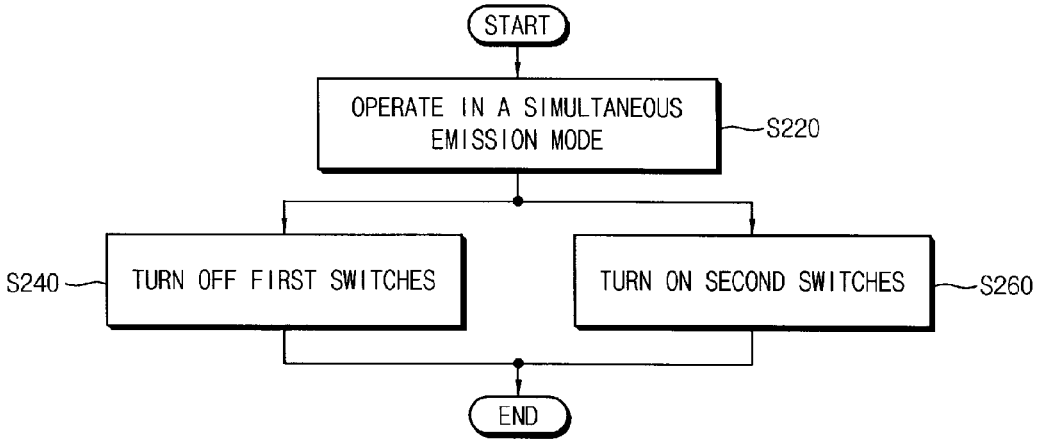
FIG. 7 is a flowchart illustrating an example in which the emission driving unit of FIG. 2 operates in a simultaneous emission mode.
Figure 8:
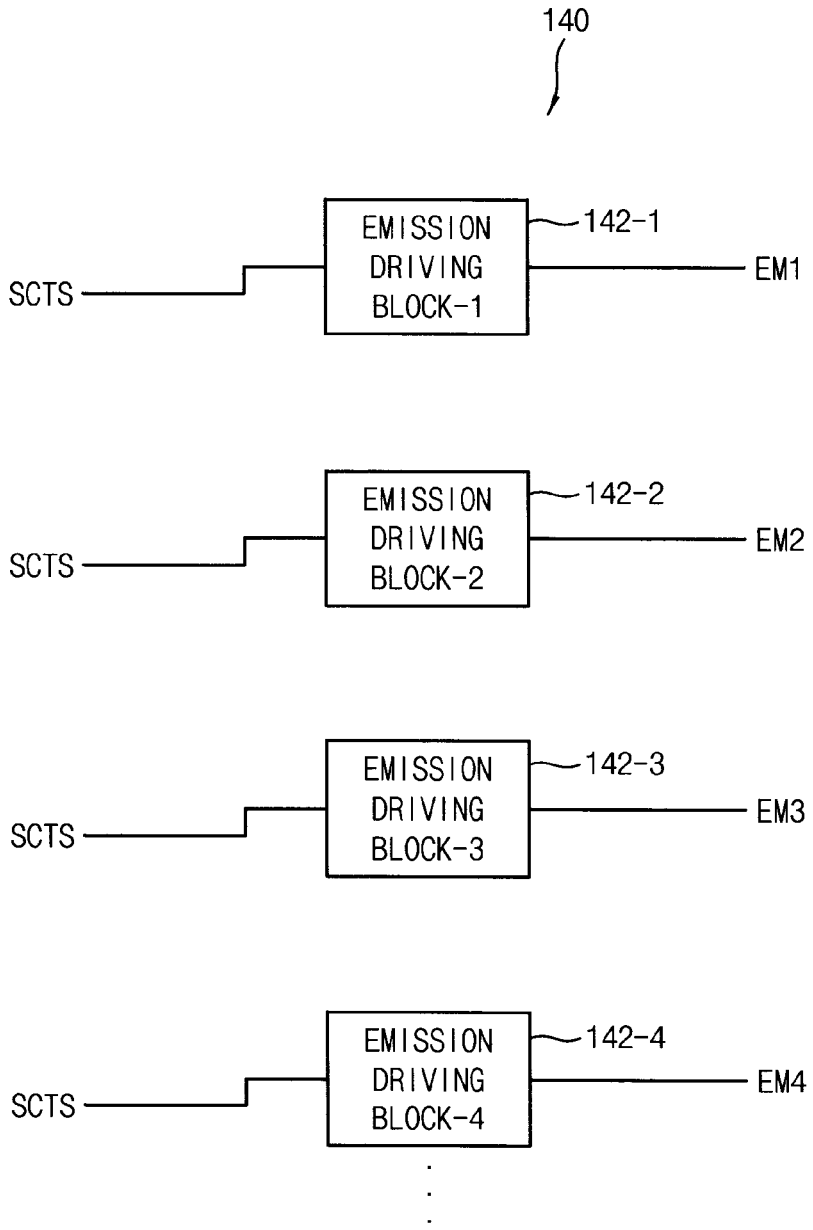
FIG. 8 is a block diagram illustrating an example in which the emission driving unit of FIG. 2 operates in a simultaneous emission mode.
Figure 9:
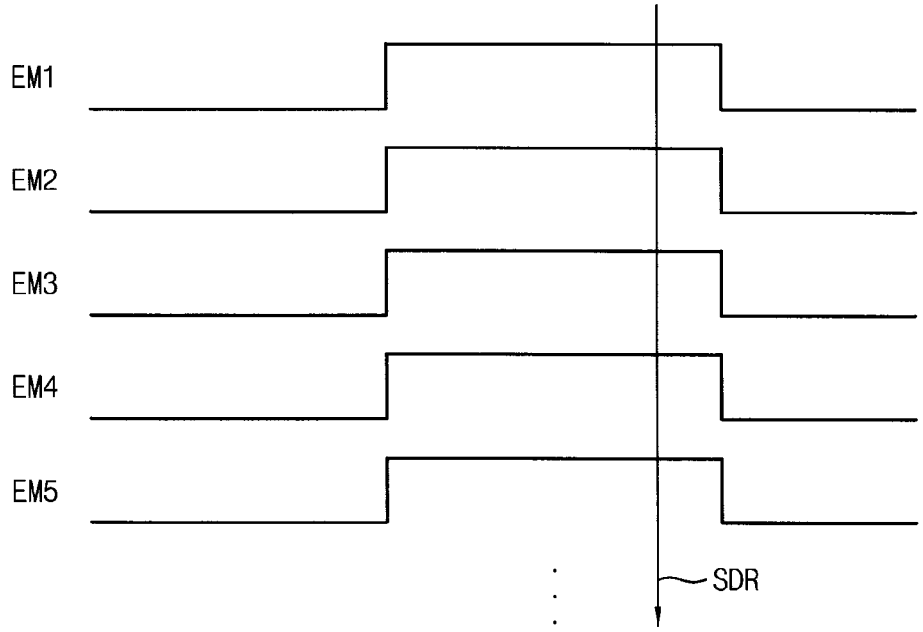
FIG. 9 is another diagram illustrating an example in which the emission driving unit of FIG. 2 operates in a simultaneous emission mode.

FIG. 7 is a flowchart illustrating an example in which the emission driving unit of FIG. 2 operates in a simultaneous emission mode. FIG. 8 is a block diagram illustrating an example in which the emission driving unit of FIG. 2 operates in a simultaneous emission mode. FIG. 9 is another diagram illustrating an example in which the emission driving unit of FIG. 2 operates in a simultaneous emission mode.

Referring to FIGS. 7 through 9, when the OLED display 100 operates in the simultaneous emission mode 240 (S220), the emission driving unit 140 turns off the first switches T1 based on the first switch control signal PCS for sequentially outputting the first through (n)th emission control signals EM1 through EMn to the display panel 110 (S240) and turns on the second switches T2 based on the second switch control signal GCS for simultaneously outputting the first through (n)th emission control signals EM1 through EMn to the display panel 110 (S260). For example, when the first switches T1 and the second switches T2 are implemented by PMOS transistors, the first switch control signal PCS has a logic "high" level and the second switch control signal GCS has a logic "low" level when the OLED display 100 operates in the simultaneous emission mode 240. Here, the first switch control signal PCS controls the first through (n)th emission control signals EM1 through EMn to be sequentially output to the display panel 110 and the second switch control signal GCS controls the first through (n)th emission control signals EM1 through EMn to be simultaneously output to the display panel 110. Thus, as illustrated in FIG. 8, when the first switches T1 are turned off and the second switches T2 are turned on, the first through (n)th emission driving blocks 142-1 through **142-*n* are arranged in parallel. As a result, the first through (n)th emission control signals EM1 through EMn are simultaneously generated based on the simultaneous driving clock signal SCTS input to the first through (n)th emission driving blocks 142-1 through 142-*n*. Therefore, as illustrated in FIG. 9, since the first through (n)th emission control signals EM1 through EMn are simultaneously output from the first through (n)th emission driving blocks 142-1 through 142-*n* to the display panel 110 (i.e., indicated as SDR), the OLED display 100 operates in the simultaneous emission mode 240**.

Figure 10:
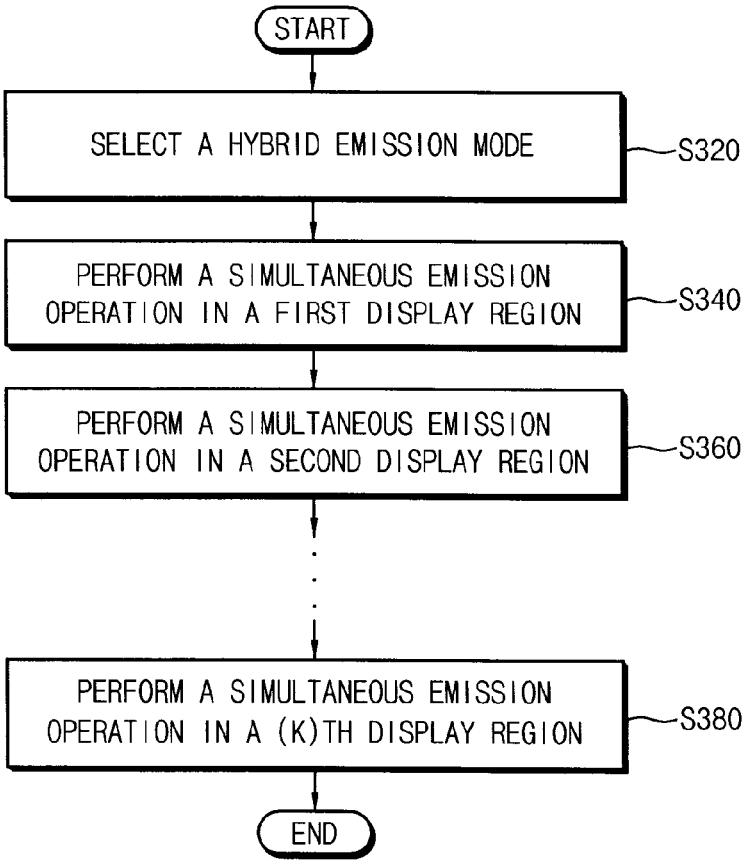
FIG. 10 is a flowchart illustrating an example in which the emission driving unit of FIG. 2 operates in a hybrid emission mode.
Figure 11:
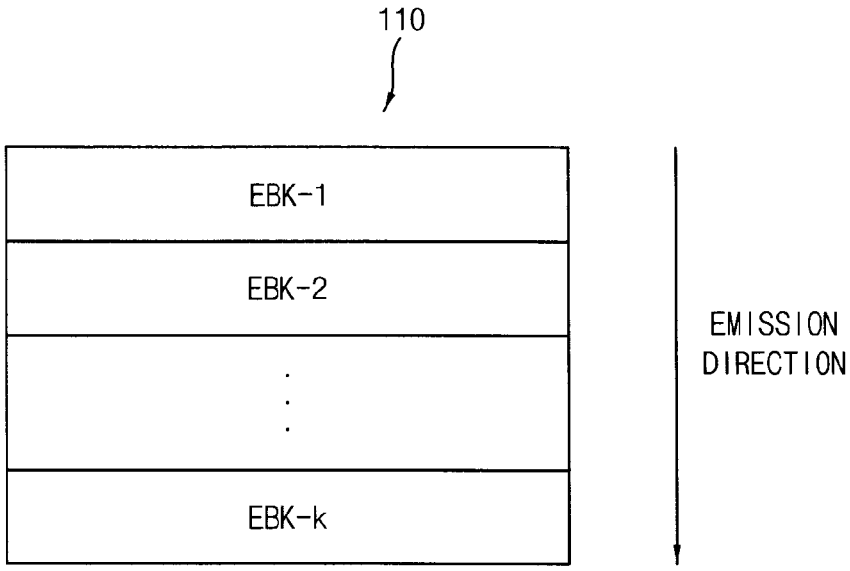
FIG. 11 is a diagram illustrating an example in which the emission driving unit of FIG. 2 operates in a hybrid emission mode.

FIG. 10 is a flowchart illustrating an example in which the emission driving unit of FIG. 2 operates in a hybrid emission mode. FIG. 11 is a diagram illustrating an example in which the emission driving unit of FIG. 2 operates in a hybrid emission mode.

Referring to FIGS. 10 and 11, the display panel 110 of the OLED display 100 includes first through (k)th display regions EBK-1 through EBK-k, where k is an integer greater than or equal to 2. Here, in a hybrid emission mode, a plurality of simultaneous emission operations are sequentially performed in the first through (k)th display regions EBK-1 through EBK-k of the display panel 110 (i.e., indicated as EMISSION DIRECTION). Specifically, when the OLED display 100 operates in the hybrid emission mode (S320), a simultaneous emission operation is performed in the first display region EBK-1 of the display panel 110 (S340). After the simultaneous emission operation in the first display region EBK-1 of the display panel 110 is completed, a simultaneous emission operation is performed in the second display region EBK-2 of the display panel 110 (S360). Similarly, after the simultaneous emission operation in the (k−1)th display region EBK-(k−1) of the display panel 110 is completed, a simultaneous emission operation is performed in the (k)th display region EBK-k of the display panel 110 (S380). In brief, when the OLED display 100 operates in the hybrid emission mode, the first through (k)th display regions EBK-1 through EBK-k of the display panel 110 sequentially perform simultaneous emission operations (i.e., indicated as EMISSION DIRECTION). Thus, all pixels included in each of the first through (k)th display regions EBK-1 through EBK-k of the display panel 110 simultaneously emit light. Here, since all pixels simultaneously emit light in an emission region (i.e., a display region selected to perform a simultaneous emission operation among the first through (k)th display regions EBK-1 through EBK-k of the display panel 110), the first switches T1 included in the emission region are turned off and the second switches T2 included in the emission region are turned on. Therefore, it may be recognized that the OLED display 100 operates in the simultaneous emission mode 240 in the emission region.

Figure 12:
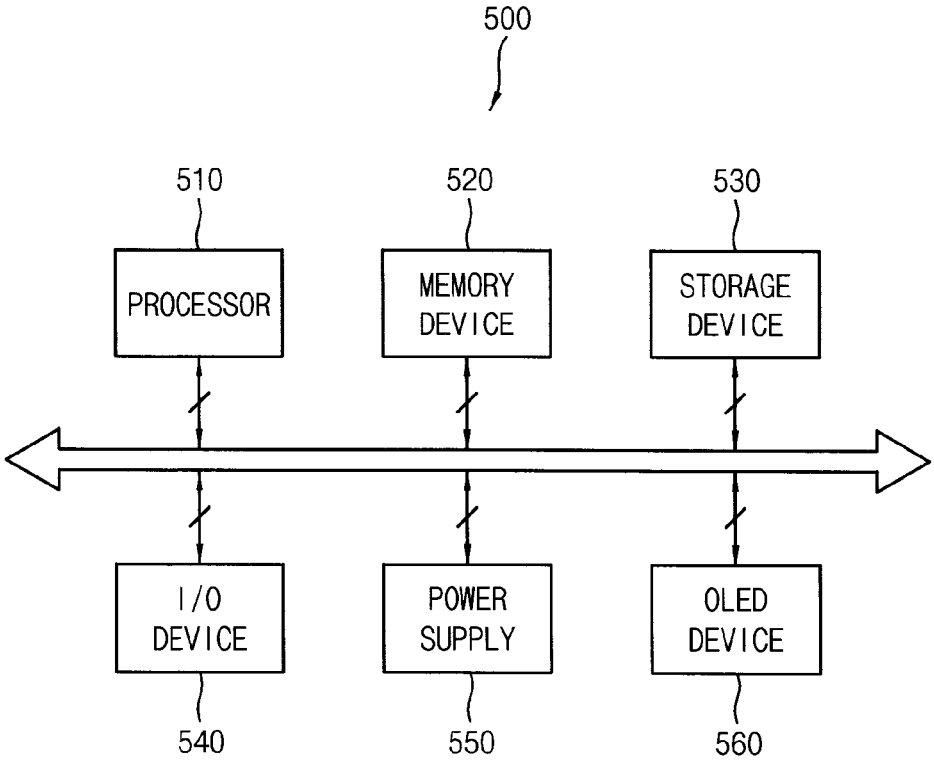
FIG. 12 is a block diagram illustrating an electronic device according to example embodiments.
Figure 13:
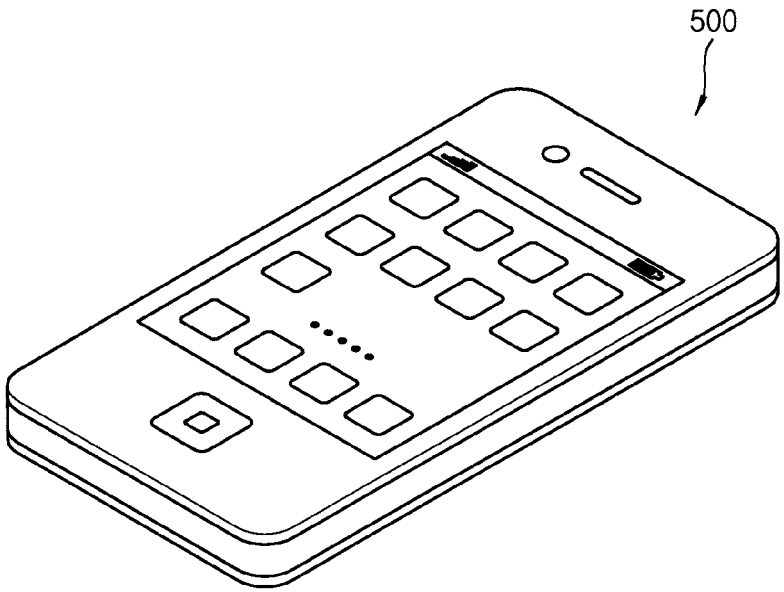
FIG. 13 is a diagram illustrating an example in which the electronic device of FIG. 12 is implemented as a smart phone.
Figure 14:
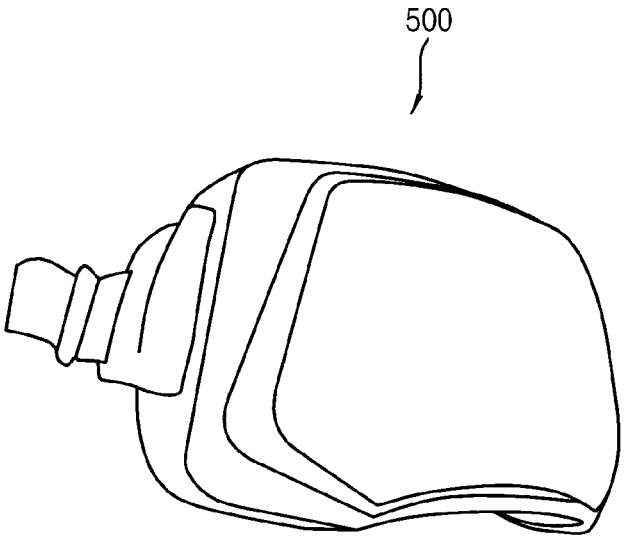
FIG. 14 is a diagram illustrating an example in which the electronic device of FIG. 12 is implemented as a head mounted display (HMD).

FIG. 12 is a block diagram illustrating an electronic device according to example embodiments. FIG. 13 is a diagram illustrating an example in which the electronic device of FIG. 12 is implemented as a smart phone. FIG. 14 is a diagram illustrating an example in which the electronic device of FIG. 12 is implemented as a head mounted display (HMD).

Referring to FIGS. 12 through 14, the electronic device 500 includes a processor 510, a memory device or memory 520, a storage device 530, an input/output (I/O) device 540, a power supply 550, and an OLED display 560. Here, the OLED display 560 may correspond to the OLED display 100 of FIG. 1. In addition, the electronic device 500 may further include a plurality of ports for communicating with a video card, a sound card, a memory card, a universal serial bus (USB) device, other electronic devices, etc. In an example embodiment, as illustrated in FIG. 13, the electronic device 500 may be implemented as a smart phone. In another example embodiment, as illustrated in FIG. 14, the electronic device 500 may be implemented as a head mounted display. However, the electronic device 500 is not limited thereto. For example, the electronic device 500 may be implemented as a television, a computer monitor, a laptop, a digital camera, a cellular phone, a video phone, a smart pad, a tablet PC, a navigation system, etc.

The processor 510 performs various computing functions. The processor 510 may be a microprocessor, a central processing unit (CPU), etc. The processor 510 may be connected to other components via an address bus, a control bus, a data bus, etc. Further, the processor 510 may be connected to an extended bus such as a peripheral component interconnection (PCI) bus. In example embodiments, the processor 510 controls the OLED display 560 to selectively operate in a progressive emission mode and/or in a simultaneous emission mode. The memory device 520 stores data for operations of the electronic device 500. For example, the memory device 520 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 530 may be a solid state drive (SSD) device, a hard disk drive (HDD) device, a CD-ROM device, etc.

The I/O device 540 may be an input device such as a keyboard, a keypad, a mouse device, a touchpad, a touchscreen, a remote controller, etc, and/or an output device such as a printer, a speaker, etc. In some example embodiments, the OLED display 560 may be included in the I/O device 540. The power supply 550 provides power for the operations of the electronic device 500. The OLED display 560 may be connected to other components via the buses or other communication links. As described above, the OLED display 560 can selectively operate in the progressive emission mode and/or in the simultaneous emission mode by sequentially or simultaneously generating emission control signals according to an external command, where the emission control signals control emission operations of pixels included in a display panel of the OLED display 560. Here, the external command may be input by a user or may be selected by a predetermined algorithm according to the images to be displayed on the display panel. For example, when the OLED display 560 is required to operate in the progressive emission mode, a user may input an external command for changing the emission mode of the OLED display 560 from the simultaneous emission mode to the progressive emission mode. In addition, when the OLED display 560 is required to operate in the simultaneous emission mode, a user may input an external command for changing the emission mode of the OLED display 560 from the progressive emission mode to the simultaneous emission mode. For example, when an image to be displayed on the display panel is suitable to the progressive emission mode of the OLED display 560, a predetermined algorithm may select an external command for changing the emission mode of the OLED display 560 from the simultaneous emission mode to the progressive emission mode. In addition, when an image to be displayed on the display panel is suitable to the simultaneous emission mode of the OLED display 560, a predetermined algorithm may select an external command for changing an emission mode of the OLED display 560 from the progressive emission mode to the simultaneous emission mode.

As described above, the OLED display 560 can selectively operate in the progressive emission mode and/or in the simultaneous emission mode. For this operation, the OLED display 560 includes a display panel, a scan driving unit, a data driving unit, an emission driving unit, a mode control unit, a power unit, and a timing control unit. The display panel includes a plurality of pixels. The scan driving unit provides scan signals to the display panel via first through (n)th scan-lines. The data driving unit provides data signals to the display panel via first through (m)th data-lines. The emission driving unit sequentially and/or simultaneously provides emission control signals to the display panel via first through (n)th emission-lines. The mode control unit controls the emission driving unit based on the selected emission mode of the OLED display 560. The power unit provides a high power voltage and a low power voltage to the display panel. The timing control unit controls the scan driving unit, the data driving unit, the mode control unit, and the power unit. In addition, the emission driving unit of the OLED display 560 includes first through (n)th emission driving blocks, first switches, and second switches. The first through (n)th emission driving blocks output the emission control signals to the display panel via the first through (n)th emission-lines. The first switches arrange the first through (n)th emission driving blocks in series when the first switches are turned on based on a first switch control signal for sequentially outputting the emission control signals to the display panel. The second switches arrange the first through (n)th emission driving blocks in parallel when the second switches are turned on based on a second switch control signal for simultaneously outputting the emission control signals to the display panel. Here, in the progressive emission mode of the OLED display 560, the first switches are turned on and the second switches are turned off. On the other hand, in the simultaneous emission mode of the OLED display 560, the first switches are turned off and the second switches are turned on. Since these are described above, duplicated description will not be repeated. In brief, the electronic device 500 provides a high-quality image to a user by including the OLED display 560 that selectively operates in the progressive emission mode and/or in the simultaneous emission mode without any structural changes according to images to be displayed.

The described technology can be applied to any system (e.g., an electronic device) including an OLED display. For example, the described technology be applied to a television, a computer monitor, a head mounted display (HMD), a laptop, a digital camera, a cellular phone, a smart phone, a video phone, a smart pad, a tablet PC, a navigation system, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An emission driver, comprising:

first through (n)th emission circuits respectively configured to output first through (n)th emission control signals, wherein the first through (n)th emission circuits are respectively connected to a display panel of an organic light-emitting diode (OLED) display via first through (n)th emission-lines, where n is an integer greater than or equal to 2;

a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

2. The emission driver of claim 1, wherein the first switches are further configured to be turned on and the second switches are further configured to be turned off when the OLED display operates in a progressive emission mode.

3. The emission driver of claim 2, wherein the first through (n)th emission circuits are further configured to sequentially generate the emission control signals based on a sequential driving clock signal applied to the first emission circuit when the OLED display operates in the progressive emission mode.

4. The emission driver of claim 1, wherein the first switches are further configured to be turned off and the second switches are further configured to be turned on when the OLED display operates in a simultaneous emission mode.

5. The emission driver of claim 4, wherein the first through (n)th emission circuits are further configured to simultaneously generate the emission control signals based on a simultaneous driving clock signal applied to each of the first through (n)th emission circuits when the OLED display operates in the simultaneous emission mode.

6. The emission driver of claim 1, wherein the first and second switches are implemented by P-channel Metal Oxide Semiconductor (PMOS) transistors or N-channel Metal Oxide Semiconductor (NMOS) transistors.

7. The emission driver of claim 6, wherein each of the first switches includes: i) a first terminal configured to receive a sequential driving clock signal or a previous emission control signal, ii) a second terminal connected to one of the first through (n)th emission circuits, and iii) a gate terminal configured to receive a first switch control signal.

8. The emission driver of claim 6, wherein each of the second switches includes: i) a first terminal configured to receive a simultaneous driving clock signal, ii) a second terminal connected to one of the first through (n)th emission circuits, and iii) a gate terminal configured to receive a second switch control signal.

9. An organic light-emitting diode (OLED) display, comprising:

a display panel including a plurality of pixels;

a scan driver configured to apply a plurality of scan signals to the display panel via first through (n)th scan-lines, where n is an integer greater than or equal to 2;

a data driver configured to provide a plurality of data signals to the display panel via first through (m)th data-lines, where m is an integer greater than or equal to 2;

an emission driver configured to provide a plurality of emission control signals to the display panel via first through (n)th emission-lines;

a mode controller configured to control the emission driver based on a selected emission mode of the OLED display;

a power supply configured to provide a high power voltage and a low power voltage to the display panel; and a timing controller configured to control the scan driver, the data driver, the mode controller and the power supply, wherein the emission driver is further configured to: i) sequentially provide the emission control signal to the display panel in response to the selected emission mode being a progressive emission mode, and ii) simultaneously provide the emission control signal to the display panel in response to the selected emission mode being a simultaneous emission mode.

10. The display of claim 9, wherein the mode controller is implemented within the timing controller.

11. The display of claim 9, wherein the emission driver includes:

first through (n)th emission circuits configured to respectively output the emission control signals to the display panel via the first through (n)th emission-lines;

a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

12. The display of claim 11, wherein the first switches are further configured to be turned on and the second switches are further configured to be turned off when the OLED display operates in the progressive emission mode.

13. The display of claim 12, wherein the emission circuits are further configured to sequentially generate the emission control signals based on a sequential driving clock signal applied to the first emission circuit when the OLED display operates in the progressive emission mode.

14. The display of claim 11, wherein the first switches are further configured to be turned off and the second switches are further configured to be turned on when the OLED display operates in the simultaneous emission mode.

15. The display of claim 14, wherein the emission circuits are further configured to simultaneously generate the emission control signals based on a simultaneous driving clock signal applied to each of the emission circuits when the OLED display operates in the simultaneous emission mode.

16. An electronic device, comprising:

an organic light-emitting diode (OLED) display including a display panel comprising a plurality of pixels, wherein the OLED display is configured to selectively operate in a progressive emission mode and in a simultaneous emission mode based on an external input and wherein the OLED display is further configured to i) generate a plurality of emission control signals, ii) apply the emission control signals to the pixels in a sequential order when the OLED display is operating in the progressive emission mode, and iii) apply the emission control signal to the pixels simultaneously when the OLED display is operating in the simultaneous emission mode; and a processor configured to control the OLED display.

17. The electronic device of claim 16, wherein the OLED display is further configured to i) receive the external input from a user or ii) select the external input via a predetermined algorithm based on images to be displayed on the display panel.

18. The electronic device of claim 16, wherein the OLED display further includes:

a scan driver configured to apply a plurality of scan signals to the display panel via first through (n)th scan-lines, where n is an integer greater than or equal to 2;

a data driver configured to apply a plurality of data signals to the display panel via first through (m)th data-lines, where m is an integer greater than or equal to 2;

an emission driver configured to sequentially or simultaneously apply the emission control signals to the display panel via first through (n)th emission-lines;

a mode controller configured to control the emission driver based on a selected emission mode of the OLED display;

a power supply configured to provide a high power voltage and a low power voltage to the display panel; and a timing controller configured to control the scan driver, the data driver, the mode controller, and the power supply.

19. The electronic device of claim 18, wherein the emission driver includes:

first through (n)th emission circuits configured to respectively output the emission control signals to the display panel via the first through (n)th emission-lines;

a plurality of first switches configured to electrically connect the first through (n)th emission circuits in series when the first switches are turned on; and a plurality of second switches configured to electrically connect the first through (n)th emission circuits in parallel when the second switches are turned on, wherein the second switches are further configured to be turned off when the first switches are turned on, and wherein the second switches are further configured to be turned on when the first switches are turned off.

20. The electronic device of claim 19, wherein the first switches are further configured to be turned on and the second switches are further configured to be turned off when the OLED display operates in the progressive emission mode and wherein the first switches are further configured to be turned off and the second switches are further configured to be turned on when the OLED display operates in the simultaneous emission mode.

* * * * *